US007930837B1

(12) United States Patent
Huebner

(10) Patent No.: US 7,930,837 B1
(45) Date of Patent: Apr. 26, 2011

(54) PRESERVER INCLUDING AN EXPANDABLE BLADDER

(76) Inventor: Michael James Huebner, Marietta, GA (US)

( * ) Notice: Subject to any disclaimer, the term of this patent is extended or adjusted under 35 U.S.C. 154(b) by 122 days.

(21) Appl. No.: 12/286,264

(22) Filed: Sep. 29, 2008

(51) Int. Cl.
*B43L 17/00* (2006.01)
*A43B 3/00* (2006.01)

(52) U.S. Cl. ..... 34/95; 34/95.1; 34/105; 12/128 R; 12/128 B; 12/114.4; 12/124

(58) Field of Classification Search ..... 34/95, 95.1, 34/105, 329, 353, 355; 12/124, 128 R, 128 B, 12/114.4
See application file for complete search history.

(56) References Cited

U.S. PATENT DOCUMENTS

| | | | | |
|---|---|---|---|---|
| 2,034,608 | A * | 3/1936 | Conrad | 12/114.4 |
| 2,173,528 | A * | 9/1939 | Beale | 422/292 |
| 5,291,669 | A * | 3/1994 | Khoury et al. | 34/95.1 |
| 5,414,975 | A * | 5/1995 | Hummel | 53/432 |
| 2006/0005328 | A1 * | 1/2006 | Johnson | 12/128 R |

* cited by examiner

*Primary Examiner* — Jiping Lu

(57) ABSTRACT

A shoe preserver having a permeable flexible covering received within a shoe. An absorbing material is disposed within the permeable flexible covering to retain moisture withdrawn from the interior surface area of the shoe. A bladder including an inlet valve is also disposed within the absorbing material. The bladder is adapted to expand the shoe preserver to completely fill an interior surface area of the shoe.

18 Claims, 6 Drawing Sheets

FIG. 3
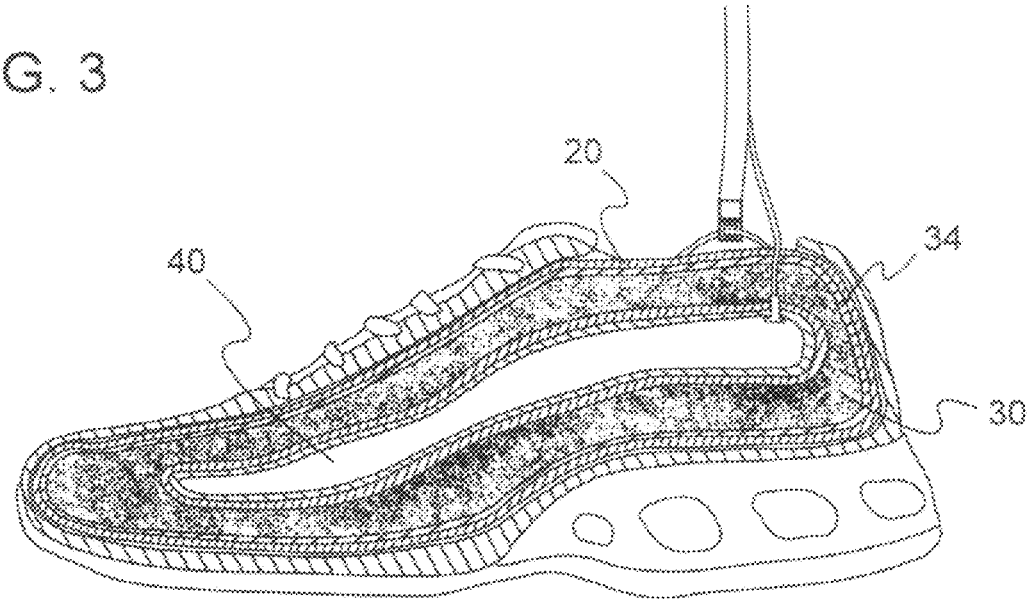
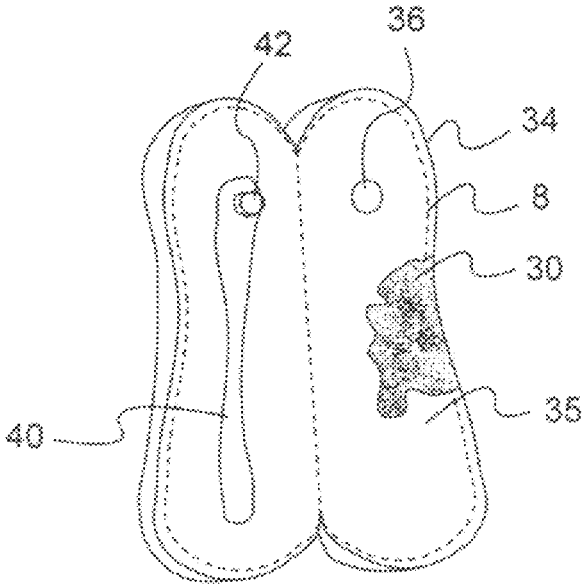
FIG. 4
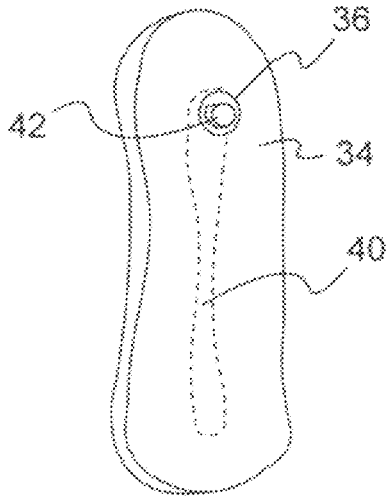
FIG. 5

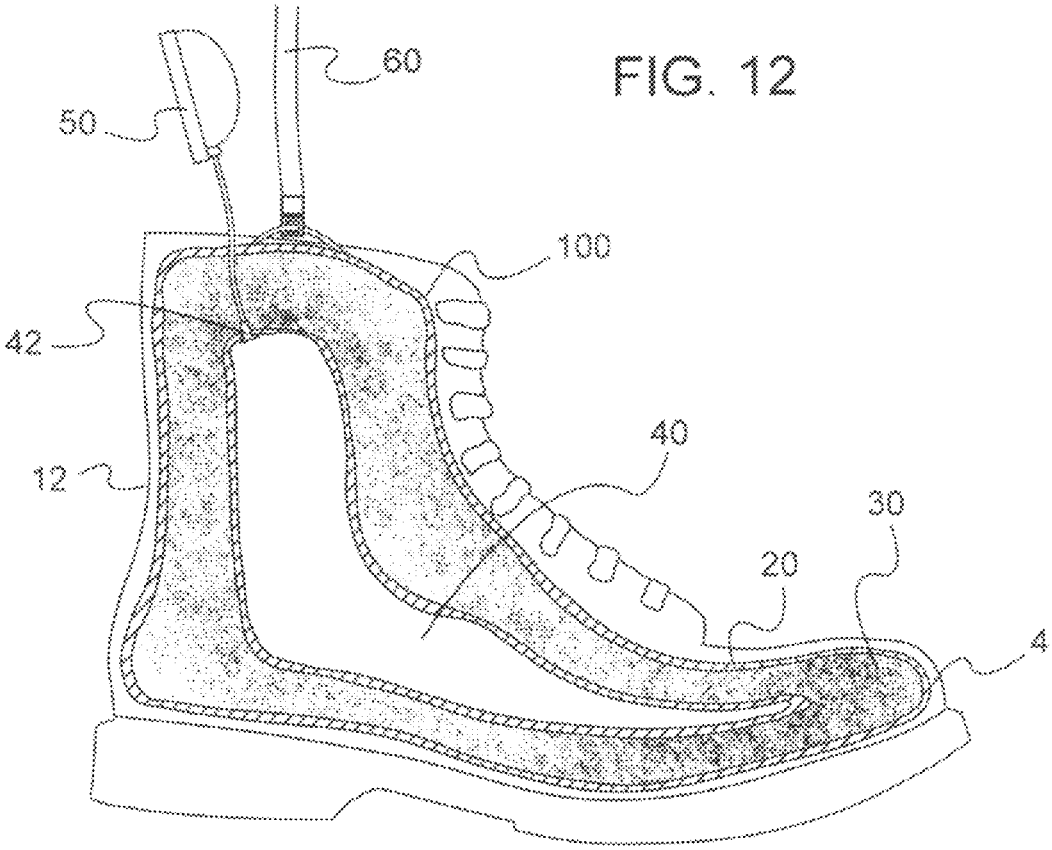
FIG. 12
FIG. 13
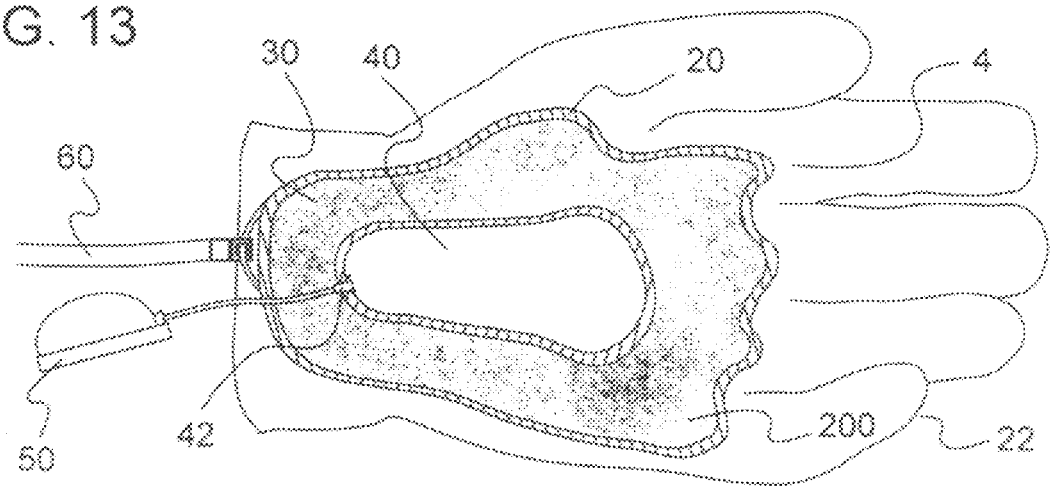

PRESERVER INCLUDING AN EXPANDABLE BLADDER

BACKGROUND OF THE INVENTION

1. Field of the Invention

This invention relates to preservers, and more particularly, to moisture absorbing preservers including an expandable bladder surrounded by an absorbing member, all disposed within a moisture permeable cover adapted to deodorize and maximize the draw of moisture from all interior surfaces of a protective covering, such as a shoe, boots, gloves, a helmet and the like.

2. Description of the Related Art

Various solutions have been proposed to deodorize, and remove moisture from a shoe. For example, U.S. Pat. No. 5,291,669 to Khoury et al. discloses a shoe preserver having a wicking portion and an absorbing portion retained within a flexible porous covering. However, the shoe preserver of Khoury et al. is not expandable to snugly fit within shoes of various sizes and shapes. Khoury et al. shoe preserver is specifically made for a particular size and shape of a shoe. Furthermore, since the Khoury et al. shoe preserver is not expandable, it cannot completely come in contact with all interior surfaces of a shoe thereby limiting the ability of the shoe preserver to maximize that moisture drawn from within the shoe.

Likewise, the following other conventionally devices also fail to maximize the amount of moisture being drawn from within the interior of a shoe. U.S. Pat. No. 3,131,036 to Hirschberg discloses a shoe drying device having a porous semi-rigid plastic foam wherein the foam defines a cavity which is filled with a powdered desiccant material. U.S. Pat. No. 896,536 to Hayden discloses a shoe tree having an absorbent sponge material surrounded by a porous fabric, wherein a wooden block or piece is disposed within the sponge material to provide for insertion and removal of the shoe tree. U.S. Pat. No. 2,173,528 to Beale discloses a disinfectant pad including an absorbent material enclosed by a porous covering.

There is still a longstanding need to solve this problem. In accordance with this invention, an exemplary moisture absorbing preserver having an expandable bladder surrounded by an absorbing member, all disposed within a moisture permeable cover adapted to deodorize and maximize the draw of moisture from all interior surfaces of various protective coverings, such as a shoe, boots, gloves, a helmet, and the like.

SUMMARY OF THE INVENTION

The present invention addresses the shortcomings identified in providing a preserver capable of absorbing moisture, as well as to deodorize a protective covering in accordance with this invention.

In one exemplary embodiment, the preserver may be implemented as a shoe preserver including a permeable flexible covering received within a shoe. An absorbing material may be disposed within the permeable flexible covering to retain moisture withdrawn from the interior surface area of the shoe. A bladder including an inlet valve is also disposed within the absorbing material. The bladder is adapted to expand the shoe preserver to completely fill an interior surface area of the shoe.

When the bladder is expanded so that the permeable flexible covering completely fills an interior surface area of the shoe, a pressure force is evenly distributed outward from the air in the bladder throughout the interior surface area of the shoe causing the shoe preserver to be securely wedged into the shoe. Consequently, the shoe preserver is prevented from slipping out of the shoe upon exertion of a sufficient perpendicular force along a strap during transport of the shoe.

Another object of this invention is to integrate a pump with an inlet valve of the bladder. When the bladder is inflated by repeatedly compressing the pump, the permeable flexible covering will completely fill the interior surface area of the shoe.

Yet another aspect of this invention is to integrate an interconnecting flexible strap including a first distal end having a first attachment point adapted to engage the first preserver, at any side and at any attachment point. And, a second distal end having a second attachment point adapted to engage the second preserver, at any side and at any attachment point.

Attachment points may be provided at the distal ends of the interconnecting flexible strap in order to secure the interconnecting flexible strap to the first and second preservers.

These and other objects, features, and/or advantages may accrue from various aspects of embodiments of the present invention, as described in more detail below.

BRIEF DESCRIPTION OF THE DRAWINGS

Various exemplary embodiments of this invention will be described in detail, wherein like reference numerals refer to identical or similar components or steps, with reference to the following figures, wherein:

FIG. 3 illustrates a side view of the preserver in an inflated state including an enclosed compartment for an absorbent material in accordance with this invention.

FIG. 4 illustrates a laid-open view of the permeable flexible liner forming a compartment for receiving a bladder therein in accordance with this invention.

FIG. 5 illustrates a closed view of the permeable flexible liner including a compartment disposed with the absorbent material and a bladder wrapped therein in accordance with this invention.

FIG. 12 is a cross-section view of a preserver and the flexible strap adapted for use with a boot in accordance with this invention.

FIG. 13 is a cross-section view of a preserver and the flexible strap adapted for use with a pair of gloves in accordance with this invention.

DETAILED DESCRIPTION OF EXEMPLARY EMBODIMENTS

Particular embodiments of the present invention will now be described in greater detail with reference to the figures.

In accordance with this invention, it is to be understood that the preserver described herein may be adapted for use with various different types of protective coverings, and that the various embodiments described and shown herein are not intended to cover all modifications and changes within the scope and spirit of the invention.

Figure 1:
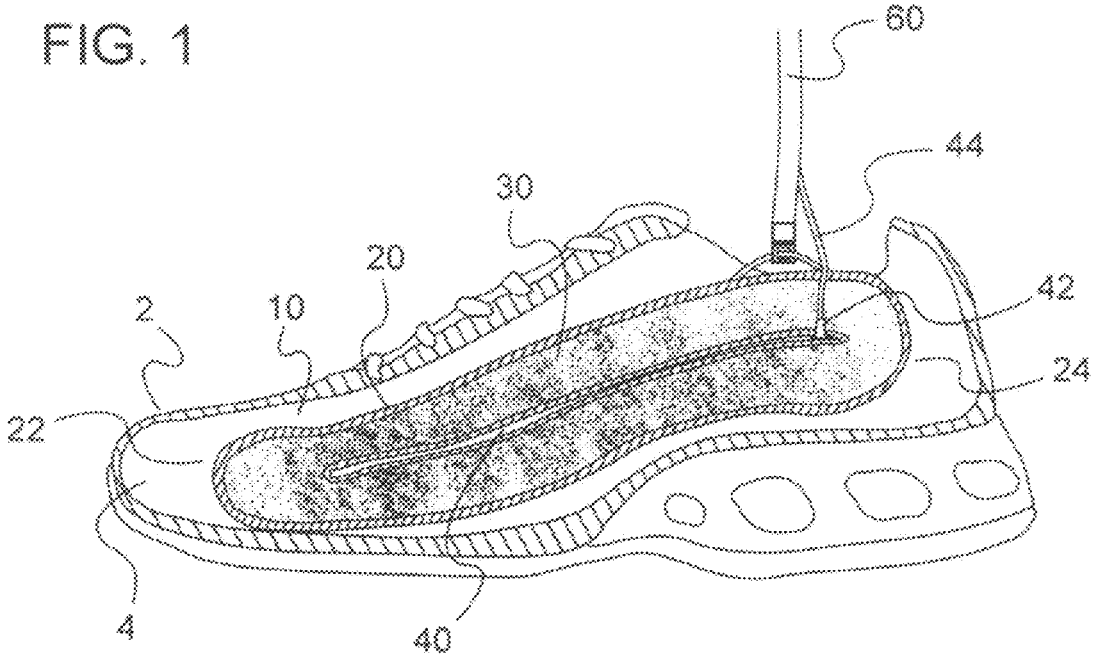
FIG. 1 illustrates a side view of the preserver in a deflated state in accordance with this invention.

FIG. 1 illustrates an exemplary shoe preserver 10 for a shoe 2 in a deflated state. As shown in the deflated state, the preserver 10 resembles the shape of a shriveled foot and includes a toe portion, a heel portion, a sole portion, and a tongue portion. The shoe preserver 10 further includes a permeable flexible covering 20, an absorbing material 30, and a bladder 40.

Figure 2:
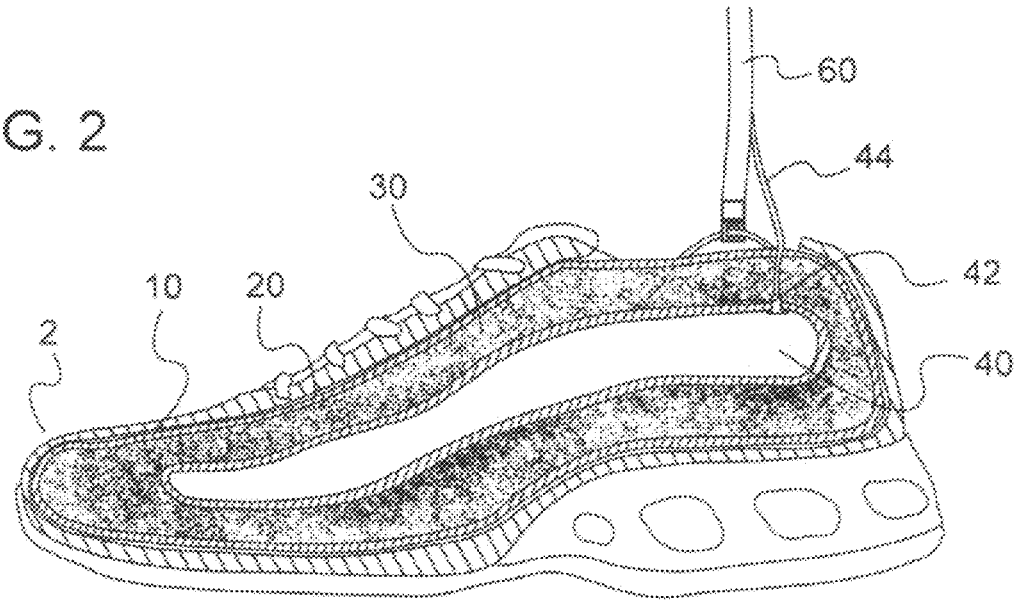
FIG. 2 illustrates a side view of the preserver in an inflated state in accordance with this invention.

FIG. 2 depicts the shoe preserver 10 in an operable inflated state in accordance with this invention. As shown in FIGS. 1 and 2, the permeable flexible covering 20 is substantially configured in the shape of a foot. The permeable flexible covering 20 includes a toe end 22 sized to be disposed within the forefoot of the shoe 2 and a heel end 24 sized to placed within the heel portion of the shoe 2.

As shown in the deflated state in FIG. 1, the permeable flexible covering 20 is sized and resembles a shriveled foot. The permeable flexible covering 20 can be expanded to fill the entire volume defined by the interior surface area 4 of the shoe 2 (as shown in FIG. 2). In the deflated state of FIG. 1, the shoe preserver 10 only nominally comes into contact with the internal surface area 4 of the shoe 2. However, in operation and as shown in FIG. 2, when the bladder 40 of the shoe preserver 10 is inflated, the shoe preserver 10 expands and fills the entire volume and internal surface area 4 of the shoe 2. In the inflated state, the shoe preserver 10 comes into direct contact with all of the internal surfaces 4 of the shoe 2.

The permeable flexible covering 20 may be formed from any number of flexible porous material, including but not limited to for example, nylon, spandex, cotton, and/or any other flexible porous material, now known or later discovered in accordance with this invention. Another aspect of the permeable flexible covering 20 is to use a material that is capable of providing sufficient flexibility so that when the bladder 40 (as described in more detail later) expands, the permeable flexible covering 20 can likewise expand to fill the internal compartment of the protective covering such that all internal surfaces may come into contact with the expanded permeable flexible covering 20. The permeable flexible covering 20 may also be capable of allowing aromatic scents there though while preventing the material substance containing the aromatic and/or deodorant from escaping across the permeable flexible covering 20 from within the preserver 10.

The absorbing material 30 is disposed within the permeable flexible covering 20 and is provided to withdraw and retain moisture from within the interior surface area 4 of the shoe 2. The absorbing material 30 may be selected from any number of absorbent, including but not limited to for example, sponge, cotton, foam, gel, cedar chips, a wicking material, and any other suitable absorbent material that biases moisture from the interior surface area of a shoe into the absorbing material, now known or later discovered in accordance with this invention.

It is within the scope of this invention to integrate a separate and/or combined wicking member (not shown) with the absorbing material 30 such that the absorbing material 30 will act to draw, or/or retain moisture from the wicking member from the interior of the shoe 2 into the absorbing material 30.

FIGS. 3-5 illustrate another aspect of this invention in which the absorbing material 30 may be constructed to be self contained separate unit within a permeable flexible liner 34. The flexible liner 34 may be positioned between the permeable flexible covering 20 and the bladder 40. In this construction, the absorbing material 30 may be disposed to evenly encase the bladder 40 such that the absorbing material 30 within the permeable flexible liner 34 may be evenly distributed within the interior volume of the shoe 2 when the bladder 40 is expanded.

The permeable flexible liner 34 may be formed as a compartment 35 by stitching 8 the permeable flexible liner 34 to form the compartment 35 into which the absorbing material 30 may be received, as shown in FIG. 4. FIG. 5 depicts the permeable flexible liner 34 in a closed configuration through whish the inlet vale 42 is extended through an orifice 36 in the permeable flexible liner 34.

Figure 6:
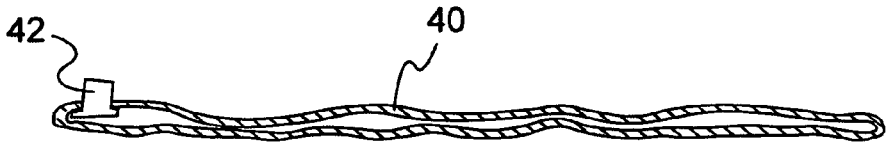
FIG. 6 is a side view of a deflated bladder including an inlet valve for receiving a source of air in accordance with this invention.
Figure 7:
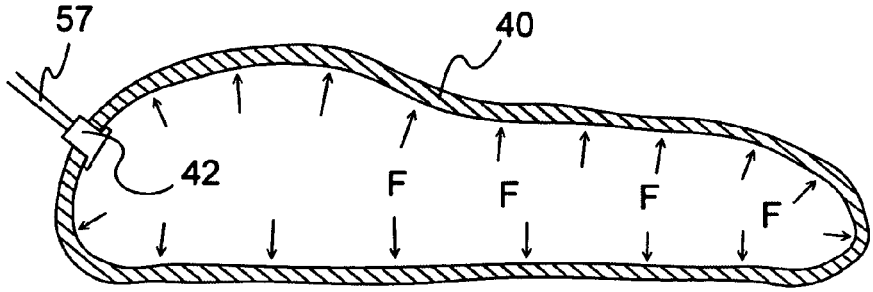
FIG. 7 is a side view of an inflated bladder including an inlet valve for receiving a source of air depicting the distributed pressure force on the bladder in accordance with this invention.

FIGS. 6-7 illustrate the bladder 40 in a deflated and an inflated state, respectively. The bladder 40 includes an inlet valve 42 adapted to receive air from an external source, which in turn expands the shoe preserver 10 to a size that completely fills the interior surface area 4 of the shoe 2, as shown in FIG. 2.

The bladder 40 may be inflated in a variety of different ways. In FIG. 6, the bladder 40 is shown substantially deflated having little air disposed therein. In FIG. 7, the bladder 40 is shown substantially inflated by an external source of air. In the shoe 2, the inflated bladder 40 is expanded so that the permeable flexible covering 20 completely fills the interior surface area 4 of the shoe 2. The bladder 40 is positioned so that when it is inflated the bladder is located central to the absorbing material 30 and urges the absorbing material 30 against the inner surface area of the shoes 4.

The bladder 40 may be inflated by manually blowing air into the inlet valve 42 by mouth until the permeable flexible covering bladder 40 expands from the deflated to the inflated state (as shown in FIGS. 6-7) to completely fill the interior surface area 4 of the shoe 2. Alternatively, and as described later, the bladder may be filled by an external pump.

The internal air disposed within the bladder 40 creates an internal pressure force (F, as shown in FIG. 7) within the bladder 40 that is transferred to the shoe preserver 10 that is evenly distributed outward throughout the interior surface area 4 of the shoe 2. The internal pressure force (F) causes the shoe preserver 10 to be securely wedged into the shoe 2. As a result of the built up internal pressure force (F) and the resultant forces acting against the shoe preserver 10, the shoe preserver 10 is securely lodged within the shoe 2 and therefore prevented from slipping out of the shoe 2. The internal pressure force (F) generated by the air pressure in the bladder 40 is substantially strong enough to overcome the exertion of a significantly strong perpendicular forces directed out of the ankle opening of the shoe 2, which would otherwise cause the shoe preserver 10 to be dislodged from the shoe 2.

Figure 8:
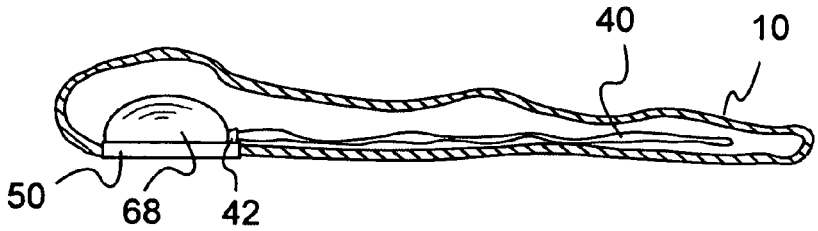
FIG. 8 is a side view of a deflated bladder including a pump disposed outside of the shoe preserver in accordance with this invention.
Figure 9:
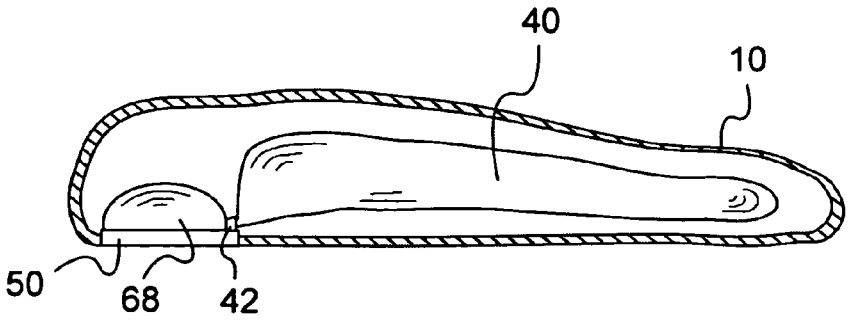
FIG. 9 is a side view of an inflated bladder including a pump disposed inside of the shoe preserver in accordance with this invention.

FIGS. 8-9 depict a simplified pump 50 as another exemplary source for producing air within the bladder 40. In FIGS.

8-9, the pump 40 is integrated as a part of the inlet valve 42 attached to the bladder 40. As shown, the bladder 40 may be inflated by repeatedly compressing a resilient bulb 68 of the pump 50 until the shoe preserver 10 completely fills the interior surface area 4 of the shoe 2.

The pump 50 may be implemented in a variety of different constructions. For example, as shown in FIGS. 8-9, the pump 50 may be integrated as part of the inlet valve 42 and the bladder 40. The pump 50 may be disposed within (as shown in FIGS. 8-9) the shoe preserver 10 and/or on an outer surface (not shown) of the preserver 10 in accordance with this invention.

The location of the pump 50 within the preserver 10 is optimally positioned so that the pump 50 is accessible for use when the preserver 10 is installed in the shoe 2. Various design constructions may be implemented to optimally position the pump 50 in an accessible position when the pump 50 is disposed within the preserver 10. For example, the pump 50 and/or portion thereof may be positioned by being fastened into the preserver 10, such as by being sewn 8 therein (as shown in FIGS. 8-9). As shown in FIGS. 6-7, the inlet valve 42 to the bladder 40 may be optimally positioned to stand adjacent to the ankle opening of the shoe 2. In use, the pump 50 may be attached to the bladder 40 through the ankle opening as shown in FIGS. 1-2. In the alternative, a pouch and/or compartment (not shown) may be formed in which the pump 50 may be placed so that it is always accessible so that the user can inflate the preserver 10.

In the alternative, the pump 50 may be a separable component constructed to work in combination with the preserver 10, 100, 200, 300, 400 as a separate pump system component disconnected from the preserver, as shown in FIGS. 12-15. It is to be understood that various types of pumps may be used in accordance with this invention, including but not limited to, a bicycle pump, an electric pump, a manual pump and/or any other pump now known or later discovered in accordance with this invention.

Figure 10:
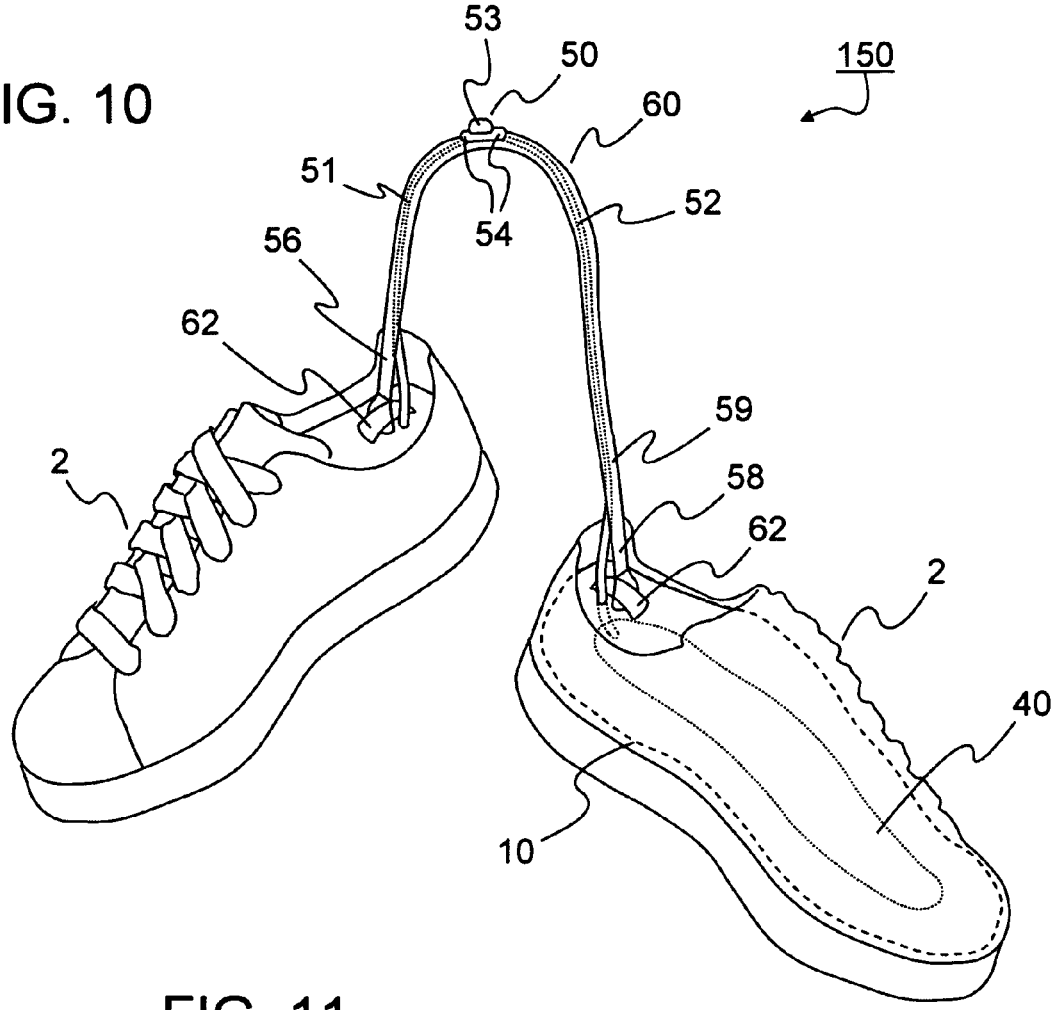
FIG. 10 is a perspective view of an integrated pump system and a flexible strap connected for transport of a pair of preservers in accordance with this invention.
Figure 11:
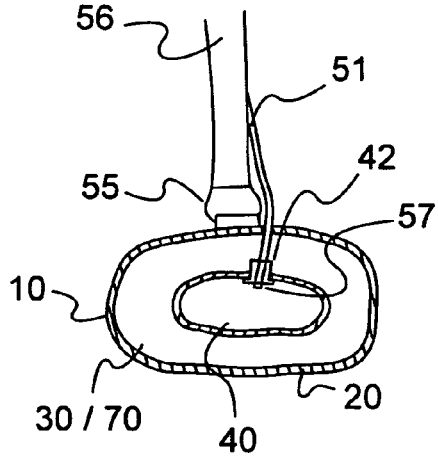
FIG. 11 is side view of a fluid line of the pump system attached to the bladder, and the flexible strap secured to the preserver at an attachment point in accordance with this invention.

FIGS. 10-11 depict the pump 50 as a separate pump system 150. In particular and as shown in FIG. 11, the pump system 150 includes a pump 50 having an inlet 53 and an outlet 54 for receiving, and dispensing air. A pair of fluid lines 51, 52 is shown extending from the pump 50. A first fluid line 51 extends from the outlet 54 of the pump 50 adjacent to a first attachment point 55 at a first distal end 56 in which a first outlet valve 57 is disposed. The first outlet valve 57 is adapted to be received by the inlet valve 42 on the bladder 40.

Likewise, a second fluid line 52 extends from the outlet 54 of the pump 50 to a second attachment point 58 at a second distal end 59 in which a second outlet valve (not shown, but similar in construction and operation to the first fluid 51 previously described in FIG. 11) is disposed. The second outlet valve is also adapted to be received by the inlet valve 42 on the other shoe preserver 10.

FIG. 10 further illustrates an interconnecting flexible strap 60 in which a pair of shoe preservers 10 may be carried. The interconnecting flexible strap 60 includes a first distal end 56 having a first attachment point 55 adapted to engage a loop fastener 62 on the preservers 10. The interconnecting flexible strap 60 also includes a second distal end 59 with a second attachment point 58 adapted to engage the other preserver 10. Although the first attachment point 55 is depicted on a first side of the shoe preserver 10, it is to be understood that the attachment points 55, 58 and the associated loop fasteners 62 may be secured on any side of the shoe preserver 10.

Although depicted as a loop fastener 62, the various attachment points 55, 58 of the interconnecting flexible strap 60 may be implemented for use, including but not limited to integrating: snaps, stitches, hook and loop fasteners, adhesives, and/or any other suitable fastener, now known or later discovered in accordance with this invention.

The interconnecting flexible strap 60 may be constructing from any number of various materials, including but not limited to nylon, cotton, plastic, and/or any other durable material for carrying various loads. Likewise, the interconnecting flexible strap 60 may be constructed to include various snaps, stitching, hook and loop fasteners, adhesives, and the like.

In more detail, FIG. 10 illustrates the combination of the interconnecting flexible strap 60 and the pump system 150. As shown, the pump system 150 may be integrated within the interconnecting flexible strap 60. As such, the modified interconnecting flexible strap 60 serves the dual purpose of carrying the shoes 2 including the shoe preservers 10 wedged within the shoes 2, as well as to provide a pumping mechanism to inflate the bladder 40 within the shoe preservers 10.

In use, the bladder 40 is expanded so that the permeable flexible covering 20 can completely fill the interior surface area 4 of the shoe 2. As mentioned before, a pressure force (F) is evenly distributed outward from the bladder 40 throughout the interior surface area 4 of the shoe 2 causing the shoe preserver 10 to be securely wedged into the shoe 2. Consequently, the shoe preserver 10 will be precluded from slipping out of the shoe 2 upon exertion of a sufficient perpendicular force exerted, in the direction of, and along the interconnecting flexible strap 60 during transport of the shoe 2.

As shown in FIG. 11, and in accordance with another aspect of this invention, a deodorant 70 may be disposed within the shoe preserver 10 to impart a pleasant odor to the shoe 2. The deodorant 70 may also be disposed within the permeable flexible covering 20 in order to deodorize the shoe 2 as the absorbing material 30 operates to withdraw moisture from the interior surface area 4 of the shoe 2.

The deodorant 70 may integrated in a variety of different forms, including but not limited to for example, a gel, a powder, cedar chips, a fluid deodorant and/or any other deodorant, now known or later discovered, in accordance with this invention.

Although the preservers 10 are previously described with respect to shoes, it is to be understood that a variety of different embodiments are possible. For example, this invention may be used in combination with any type of protective covering, including but not limited to, a boot, a glove, and/or a hat.

FIG. 12, by way of example, illustrates the use of a pair of boot preservers 100 used in combination with a pair of boots 12. In an un-inflated state, the boot preserver 100 resembles the shape of a shriveled sock that can be easily inserted within each of the boots 12. As shown in FIG. 13 in an inflated state, the boot preservers 100 include a permeable flexible covering 20, an absorbing material 30, a bladder 40, a pump 50, and an interconnecting flexible strap 60. The various components that make up the boot preservers 100 include all of the features and functionality of the other preservers 10, 200, 300 described herein.

In use, the pump 50 is integrated as a part of the inlet valve 42 of the bladder 40. As shown, the bladder 40 may be inflated by repeatedly compressing a resilient bulb 68 in the pump 50 until the permeable flexible covering 20 completely fills the interior surface area 4 of the boot 12.

A flexible strap 60 may be attached to the various boot preservers 100 which will make holding and finding the pair of boots 12 easy. The flexible strap 60 may be modified to carry other accessories commonly used when wearing a pair of boots, such as a gloves, a jacket, a scarf, ear muffs, a hat and the like.

As shown in more detail in FIG. 10, a first distal end 55 of the flexible strap 60 includes a first attachment point 56 adapted to engage the boot preserver 100. Likewise, a second distal end 59 of the flexible strap 60 includes a second attachment point 58 adapted to engage the boot preserver 100.

FIG. 13 illustrates the use of a glove preserver 200 used in combination with a pair of gloves 22. In an un-inflated state, the glove preserver 200 resembles the shape of a shriveled hand that easily fits within each of the gloves 22. As shown in the inflated state, the glove preserver 200 includes a permeable flexible covering 20, an absorbing material 30, a bladder 40, a pump 50, and an interconnecting flexible strap 60. The various components that make up the glove preserver 200 include all of the features and functionality of the other preservers 10, 100, 300 described herein.

In use, the pump 50 is integrated as a part of the inlet valve 42 of the bladder 40. As shown, the bladder 40 may be inflated by repeatedly compressing a resilient bulb 68 in the pump 50 until the permeable flexible covering 20 completely fills the interior surface area 4 of the glove 22.

A flexible strap 60 may be attached to the various glove preservers 200 which will make holding and finding the pair of gloves 22 easy. The flexible strap 60 may be modified to carry other accessories commonly used when using a pair of gloves, such as a jacket, a scarf, ear muffs, a hat and the like.

As shown in more detail in FIG. 10, a first distal end 55 of the flexible strap 60 includes a first attachment point 56 adapted to engage the glove preserver 200. Likewise, a second distal end 59 of the flexible strap 60 includes a second attachment point 58 adapted to engage the glove preserver 200.

Figure 14:
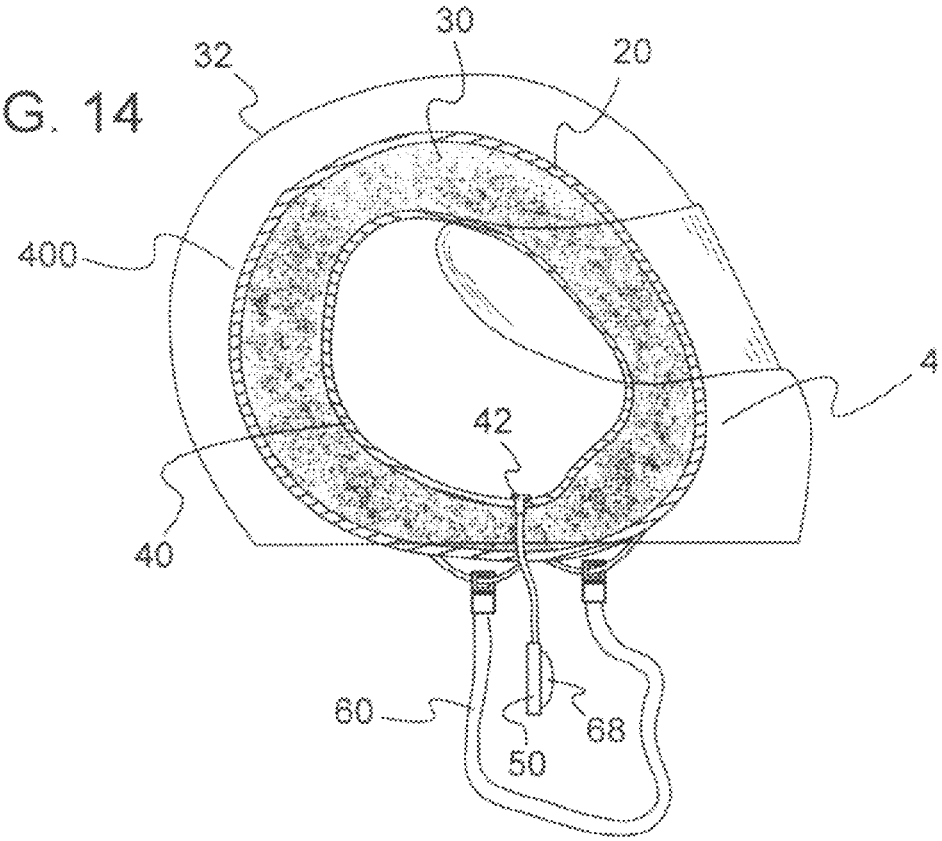
FIG. 14 is a cross-section view of a preserver and the flexible strap adapted for use with a helmet in accordance with this invention.
Figure 15:
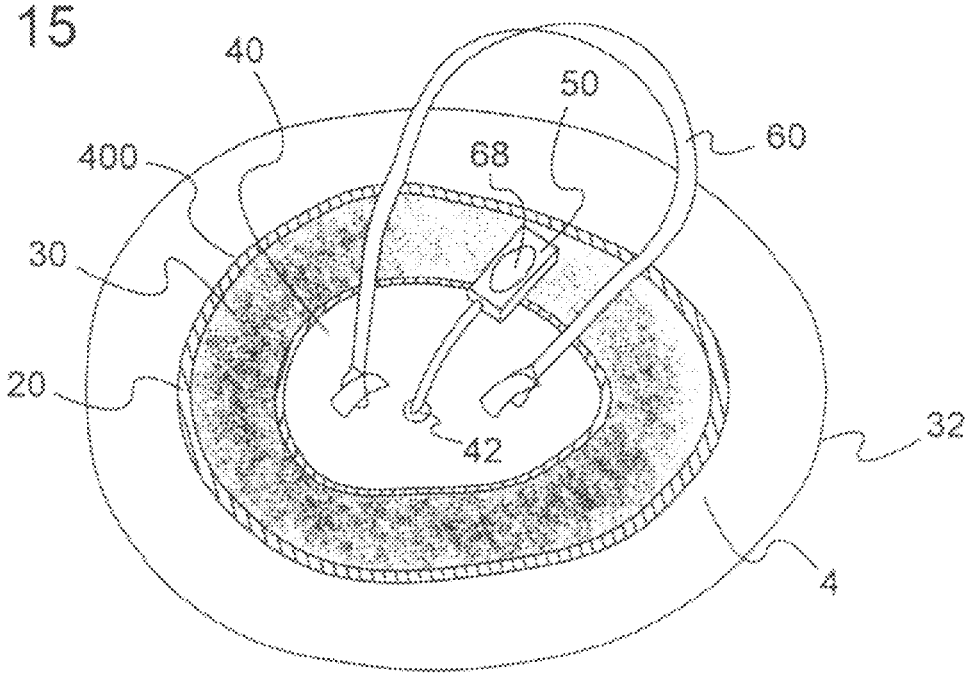
FIG. 15 is a bottom cross-section view of the preserver and the flexible strap adapted for use with the helmet in accordance with this invention.

FIGS. 14-15 illustrate the use of a helmet preserver 300 used in combination with a helmet 32. In an un-inflated state, the helmet preserver 300 resembles the shape of a shriveled ball suitable to be easily inserted within the helmet 32. As shown in an inflated state, the helmet preserver 300 includes a permeable flexible covering 20, an absorbing material 30, a bladder 40, a pump 50, and an interconnecting flexible strap 60. The various components that make up the helmet preserver 300 include all of the features and functionality of the other preservers 10, 100, 200 described above.

In use, the pump 50 is integrated as a part of the inlet valve 42 of the bladder 40. As shown, the bladder 40 may be inflated by repeatedly compressing a resilient bulb 68 in the pump 50 until the permeable flexible covering 20 completely fills the interior surface area 4 of the helmet 32.

A flexible strap 60 is attached to the helmet preserver 300 that can be easily gripped to carry the helmet 32. The flexible strap 60 may also be modified to carry other accessories, such as gloves, a jacket, riding pants and the like.

As shown in more detail in FIG. 10, a first distal end 55 of the flexible strap 60 includes a first attachment point 56 adapted to engage the helmet preserver 300. Likewise, a second distal end 59 of the flexible strap 60 includes a second attachment point 58 adapted to engage the helmet preserver 300.

It will be recognized by those skilled in the art that changes or modifications may be made to the above described embodiments without departing from the broad inventive concepts of the invention. It is understood therefore that the invention is not limited to the particular embodiments which are described, but is intended to cover all modifications and changes within the scope and spirit of the invention.

What is claimed is:

1. A pair of preservers for shoes, in which the shoes include a toe portion, a heel portion, and a tongue portion, wherein each preserver includes a toe end and a heel end, comprising:

a permeable flexible covering received within a shoe;

an absorbing material within the permeable flexible covering for retaining moisture withdrawn from the interior surface area of the shoe; and a bladder disposed within, and substantially along the length of the permeable flexible covering from the heel portion to the toe portion, the bladder being surrounded by the absorbing material and having an inlet valve adapted to expand the bladder which urges the absorbing material against the permeable flexible covering, which in turn expands the permeable flexible covering outward to completely fill an interior surface area of the shoe.

2. The pair of shoe preservers of claim 1, wherein when the bladder is expanded so that the permeable flexible covering completely fills an interior surface area of the shoe, a pressure force is evenly distributed outward from the air in the bladder throughout the interior surface area of the shoe causing the shoe preserver to be securely wedged into the shoe thereby preventing the shoe preserver from slipping out from the shoe upon exertion of a sufficient perpendicular force along a strap during transport of the shoe.

3. The pair of shoe preservers of claim 1, wherein the absorbing material may be a wicking material that biases moisture from the interior surface area of the shoe into the absorbing material.

4. The pair of shoe preservers of claim 1, wherein the absorbing material is self contained within a permeable flexible liner between the permeable flexible covering and the bladder.

5. The pair of shoe preservers of claim 1, wherein the bladder may be inflated by manually blowing air into the inlet valve with a mouth until the permeable flexible covering completely fills the interior surface area of the shoe.

6. The pair of shoe preservers of claim 1, wherein a pump is integrated with the inlet valve of the bladder, wherein the bladder is inflated by repeatedly compressing the pump until the permeable flexible covering completely fills the interior surface area of the shoe.

7. The pair of shoe preservers of claim 1, wherein the pump is disposed within the shoe preserver, or on an outer surface of the shoe preserver.

8. The pair of shoe preservers of claim 1, wherein each preserver further comprises:

an interconnecting flexible strap comprising:

a first distal end having a first attachment point adapted to engage the first preserver, at any side and at any attachment point; and a second distal end having a second attachment point adapted to engage the second preserver, at any side and at any attachment point.

9. The pair of shoe preservers of claim 8, wherein:

the first attachment point at the first distal end of the interconnecting flexible strap is a fastener adapted to be secured to the first preserver; and the second attachment point at the second distal end of the interconnecting flexible strap is a fastener adapted to be secured to the second preserver.

10. The pair of shoe preservers of claim 8, wherein the interconnecting flexible strap includes a pump system, wherein the pump system comprises:

a pump having an inlet and an outlet; and a pair of fluid lines that extend from the pump, wherein:

a first fluid line extends from the outlet of the pump to the first attachment point at the first distal end in which a first outlet valve is disposed and adapted to be received by the inlet valve on the preserver; and a second fluid line extends from the outlet of the pump to the second attachment point at the second distal end in which a second outlet valve is disposed and adapted to be received by the inlet valve on the preserver.

11. The pair of shoe preservers of claim 1, wherein the preservers further comprise:

a deodorant disposed within the covering that deodorizes the shoe as the absorbing material withdraws moisture from the interior surface area of the shoe.

12. The pair of shoe preservers of claim 11, wherein the deodorant may be chosen from at least one of a gel, a powder, cedar chips, or a fluid deodorant.

13. The pair of shoe preservers of claim 1, wherein each preserver further comprises:

a wicking material within the covering for withdrawing moisture from the shoe.

14. The pair of shoe preservers of claim 1, wherein the covering is composed of an absorption material adapted to withdrawing moisture from the shoe.

15. A preserver, comprising:

a permeable flexible enclosure received within a protective covering;

an absorbing material disposed within the permeable flexible enclosure for retaining moisture withdrawn from an interior surface area of the protective covering; and a bladder disposed within the absorbing material, and substantially along the length of the permeable flexible enclosure from the heel portion to the toe portion, the bladder being surrounded by the absorbing material and having an inlet valve disposed within the bladder, the bladder adapted to expand, which urges the absorbing material against the permeable flexible enclosure, which in turn expands the permeable flexible enclosure outward to completely fill the interior surface area of the protective covering.

16. The preserver of claim 15, wherein when the bladder is expanded so that the permeable flexible enclosure completely fills the interior surface area of the protective covering, a pressure force is evenly distributed outward from within the bladder throughout the interior surface area of the protective covering causing the preserver to be securely wedged into the protective covering thereby preventing the preserver from slipping out of the protective covering upon exertion of a sufficient perpendicular force along the strap during transport of the protective covering.

17. The preserver of claim 15, wherein the protective covering is selected from at least one of a shoe, a boot, a glove, or a hat.

18. A preserver for shoes including a toe end and a heel end, comprising:

a permeable flexible covering received within a shoe;

an absorbing material disposed within the permeable flexible covering for retaining moisture withdrawn from the interior surface area of the shoe;

a bladder disposed within the absorbing material, and substantially along the length of the permeable flexible covering from the heel portion to the toe portion, the bladder being surrounded by the absorbing material and having an inlet valve; and a pump having an inlet for receiving external air, and an outlet connected to the inlet valve of the bladder, wherein when the pump is repeatedly compressed, the bladder is expanded so that the bladder urges the absorbing material against the permeable flexible covering, which in turn expands the permeable flexible covering outward to completely fill an interior surface area of the shoe, and a pressure force is generated that is evenly distributed outward from the bladder against the absorbing material and throughout the interior surface area of the shoe causing the preserver to be securely wedged into the shoe thereby preventing the preserver from slipping out of the shoe upon exertion of a sufficient perpendicular force along the strap during transport of the shoe.

* * * * *